US006140003A

United States Patent [19]

Sacripante et al.

[11] Patent Number: 6,140,003

[45] **Date of Patent: *Oct. 31, 2000**

[54] TONER COMPOSITIONS WITH CHARGE ENHANCING RESINS

[75] Inventors: Guerino G. Sacripante, Oakville; Richard P. N. Veregin, Mississauga, both of Canada

[73] Assignee: Xerox Corporation, Stamford, Conn.

[ * ] Notice: This patent is subject to a terminal disclaimer.

[21] Appl. No.: 08/221,595

[22] Filed: Apr. 1, 1994

[51] Int. Cl.[7] ..... G03G 9/097

[52] U.S. Cl. ..... 430/110; 430/109

[58] Field of Search ..... 430/110, 904, 430/109, 126

[56] References Cited

U.S. PATENT DOCUMENTS

| | | | |
|---|---|---|---|
| 4,298,672 | 11/1981 | Lu | 430/108 |
| 4,397,935 | 8/1983 | Ciccarelli et al. | 430/110 |
| 4,560,635 | 12/1985 | Hoffend et al. | 430/106.6 |
| 4,837,391 | 6/1989 | Anderson et al. | 430/110 |
| 4,837,392 | 6/1989 | Anderson et al. | 430/110 |
| 4,837,393 | 6/1989 | Alexandrovich et al. | 430/110 |
| 4,837,394 | 6/1989 | Alexandrovich et al. | 430/110 |
| 4,935,326 | 6/1990 | Creatura et al. | 430/108 |
| 4,937,166 | 6/1990 | Creatura et al. | 430/108 |
| 5,198,320 | 3/1993 | Vreeland et al. | 430/110 |
| 5,348,832 | 9/1994 | Sacripante et al. | 430/109 |

OTHER PUBLICATIONS

Diamond, Arthur S. (1991) *Handbook of Imaging Materials*. New York: Marcel–Dekker, Inc. pp. 163–176.

*Primary Examiner*—Christopher D. Rodee
*Attorney, Agent, or Firm*—E. O. Palazzo

[57] ABSTRACT

A toner composition comprised of resin particles, pigment and a charge enhancing additive comprised of a polymer or said resin particles with a charge enhancing moiety chemically attached thereto, and which charge additive is of the formula

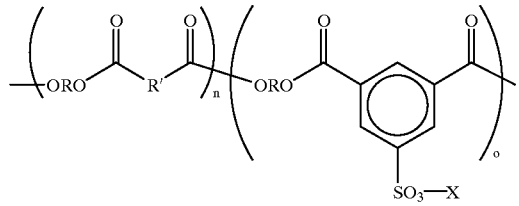

wherein X is an alkaline, an alkaline earth metal, a metal, or the ammonium cation $H_4N+$, $R''_4N+$ wherein R" is an alkyl or arylalkyl group; R is alkylene, cyclohexyl, bisphenol, bis(alkyloxyl), or oxyalkylene; and R' is an alkylene, an arylene, cycloalkylene group.

12 Claims, No Drawings

TONER COMPOSITIONS WITH CHARGE ENHANCING RESINS

BACKGROUND OF THE INVENTION

This invention is generally directed to toner and developer compositions, and more specifically, the present invention is directed to developer and toner compositions containing resins wherein the charge enhancing functionality is incorporated in the main chain of the polymeric resin, and which resins, for example, impart or assist in imparting a positive or negative charge to the toner resin particles and enable toners with rapid admix characteristics. In embodiments, there are provided in accordance with the present invention toner compositions comprised of resin particles, pigment particles, and wherein the polymeric toner resin contains a functional moiety such as a distearyl dimethyl ammonium 2,4-isophthaloyl sulfonate, sodio 2,4-isophthaloyl sulfonate, or calcio 2,4-isophthaloyl sulfonate and the like; and which resin imparts or assists in imparting negative charge characteristics to the toner resin particles and enable toners with rapid admix characteristics such as less than 60 seconds. More specifically, in embodiments of the present invention, there is provided a toner comprised of pigment particles and a polyester resin containing the functional charge enhancing functionality as illustrated by the formula

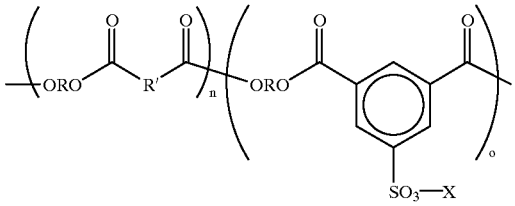

wherein X is an alkaline ion such as H+, Na+, Li+, K+, Rb+, or Cs+; an alkaline earth metal such as $Be^2$+, $Mg^2$+, $Ca^2$+, $Sr^2$+, or $Ba^2$+; a metal such as $V^2$+, $Cr^2$+, $Zr^2$+, $Mn^2$+, $Fe^2$+, $Fe^3$+, $Co^2$+, $Ni^2$+, $Zn^2$+, Ag+, $Cd^2$+, or an ammonium cation such as $H_4N$+, or $R''_4N$ + wherein R" is an alkyl or arylalkyl group of from about 1 carbon atom to about 40 carbon atoms; R is alkylene, cyclohexyl, bisphenol, bis(alkyloxyl), or oxyalkylene; and R' is an alkylene, an arylene, or cycloalkylene group of from about 1 carbon atom to about 40 carbon atoms. Alkylene includes components with from 1 to about 40 carbon atoms like ethylene, propylene, butylene, hexylene, and the like; arylene includes groups with from about 6 to about 30 carbon atoms like phenylene, biphenylene, anthralene, and the like; and cycloalkylene of from about 1 to about 40 carbon atoms like cyclohexylene, 1,4-dimethylcyclohexylene, cyclopentylene, and the like.

The toner compositions and developer thereof, that is the toner mixed with the carrier, displays negative charge characteristics such as from about −10 to −45 microcoulombs per gram and preferably of from about −10 to −40 microcoulombs per gram, or positive charge characteristics such as from about 10 to 45 microcoulombs per gram and preferably of from about 10 to 40 microcoulombs per gram. Also, the aforementioned developer compositions display rapid admix of less than about 60 seconds, extended developer life, stable electrical properties, high image print quality with substantially no background deposits, excellent relative humidity sensitivity such as from about 1.2 to about 2.5, and compatibility with fuser rolls including VITON® fuser rolls. Also, the aforementioned toner compositions usually contain pigment particles comprised of, for example, carbon black, magnetites, or mixtures thereof, cyan, magenta, yellow, blue, green, red, or brown components, or mixtures thereof thereby providing for the development and generation of black and/or colored images. The toner compositions of the present invention in embodiments thereof possess excellent admix characteristics as indicated herein, and maintain their triboelectric charging characteristics for an extended number of imaging cycles up to, for example 1,000,000 in a number of embodiments. The toner and developer compositions of the present invention can be selected for electrophotographic, especially xerographic imaging and printing processes, including color processes.

Developer compositions with charge enhancing additives, which impart a positive, or negative charge to the toner resin, are known. Thus, for example, there is described in U.S. Pat. No. 3,893,935 the use of quaternary ammonium salts as charge control agents for electrostatic toner compositions. In this patent, there are disclosed quaternary ammonium compounds with four R substituents on the nitrogen atom, which substituents represent an aliphatic hydrocarbon group having 7 or less, and preferably about 3 to about 7 carbon atoms, including straight and branch chain aliphatic hydrocarbon atoms, and wherein X represents an anionic function including, according to this patent, a variety of conventional anionic moieties such as halides, phosphates, acetates, nitrates, benzoates, methylsulfates, perchloride, tetrafluoroborate, benzene sulfonate, and the like; U.S. Pat. No. 4,221,856 which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens such as iodide, chloride and bromide, reference the Abstract of the Disclosure, and column 3; a similar teaching is presented in U.S. Pat. No. 4,312,933 which is a division of U.S. Pat. No. 4,291,111; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014; 4,394,430 and 4,560,635 which illustrates a toner with a distearyl dimethyl ammonium methyl sulfate charge additive. One disadvantage associated with the charge additive of the '635 patent resides in its apparent inherent instability in some instances thus rendering it substantially unsuitable as a bulk toner constituent in imaging processes, as the additive can thermally and chemically degrade and react with other toner components.

The following United States patents are also mentioned: U.S. Pat. No. 4,812,381 which discloses toners and developers containing charge control agents comprising quaternary ammonium salts of the formula indicated, for example, in the Abstract of the Disclosure, wherein R is alkyl with from 12 to 18 carbon atoms, and the anion is a trifluoromethylsulfonate; a similar teaching is presented in U.S. Pat. No. 4,834,921; U.S. Pat. No. 4,490,455 which discloses toners with, for example, amine salt charge enhancing additives, reference the Abstract of the Disclosure, for example, and wherein na is an anion including those derived from aromatic substituted sulfonic acids, such as benzene sulfonic acid, and the like, see column 3 beginning at line 33; U.S. Pat. No. 4,221,856 directed to toners with a quaternary ammonium compound wherein A is an anion such as sulfate, sulfonate, nitrate, borate, chlorate, and certain halogens, see the Abstract of the Disclosure; Reissue U.S. Pat. No. 32,883 (a reissue of U.S. Pat. No. 4,338,390) illustrates toners with sulfate and sulfonate charge additives, see the Abstract of the Disclosure, wherein $R_4$ is an alkylene, and the anion contains a $R_5$ which is a tolyl group, or an alkyl group of from 1 to 3 carbon atoms, and n is the number 3 or 4; U.S. Pat. No. 4,323,634 which discloses toners with charge additives of the formulas presented in column 3, wherein proving that at least one of the R's is a long chain amido group, and X is a halide ion or an organosulfur containing group; U.S. Pat. No. 4,326,019 relating to toners with long chain hydrazinium compounds, wherein the anion A can be a sulfate, sulfonate, phosphate, halides, or nitrate, see the Abstract of the Disclosure for example; U.S. Pat. No. 4,752,550 which illustrates toners with inner salt charge additives, or mixtures of charge additives, see for example column 8; U.S. Pat. No. 4,684,596 which discloses toners with charge additives of the formula provided in column 3 wherein X can be variety of anions such as trifluoromethane sulfonate; and U.S. Pat. Nos. 4,604,338; 4,792,513; 3,893,935; 4,826,749 and 4,604,338. The disclosure of each of the aforementioned patents is totally incorporated herein by reference.

The following prior art, all U.S. patents, are also recited: U.S. Pat. No. 4,812,381 relating to toners and developers with quaternary ammonium salts of the formula illustrated in column 3, the preparation thereof, see column 4, and also note the working Examples, columns 7 and 8, wherein specific charge additives, such as octadecyl ammonium trifluoromethane sulfonate, are reported; U.S. Pat. No. 4,752,550, the disclosure of which is totally incorporated herein by reference, directed to toners and developers with inner salt charge additives and mixtures of such salts with other charge additives, see for example column 4; and Reissue U.S. Pat. No. 32,883 (a reissue of U.S. Pat. No. 4,338,390), the disclosures of which are totally incorporated herein by reference, wherein toners with organic sulfonate and organic sulfate charge enhancing additives are illustrated, see columns 3, 4, and 5 to 10 for example.

Moreover, toner compositions with negative charge enhancing additives are known, reference for example U.S. Pat. Nos. 4,411,974 and U.S. Pat. No. 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives. A number of other patents illustrate toners with charge additives, such as U.S. Pat. No. 4,845,003 wherein toners with aluminum complexes, such as BONTRON E-88™ are illustrated.

There is illustrated in U.S. Pat. No. 4,404,271 a complex system for developing electrostatic images with a toner which contains a metal complex represented by the formula in column 2, for example, and wherein ME can be chromium, cobalt or iron. Additionally, other patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives.

While many charge enhancing additives are known, there continues to be a need for toners wherein charge enhancing additives can be avoided. It is known that the addition of charge enhancing additives to toners, such as distearyl dimethyl ammonium methyl sulfate and the like can increase the minimum fixing temperature of the resin, accompanied by narrowing of fusing latitude and blocking characteristics. In the present invention, the use of separate charge enhancing additive compounds are avoided since the toner contains a polymeric resin comprised of a charge enhancing functional moiety capable of providing negative charging characteristics such as from about −10 to about −40 microcoulombs per gram, or provide positive charging characteristics such as from about 10 to about 40 microcoloumbs and fast admix times such as less than 30 seconds without increasing the minimum fixing temperature, or narrowing the fusing latitude or reducing blocking characteristics. In embodiments, negative triboelectricals can result with Xerox Corporation carriers available as 9200 carrier comprised of a steel core with a polyvinylidene coating of 0.75 weight percent, and positive tribos result with, for example, Xerox Corporation 1075 and 5090 carriers comprised, for example, of oxidized steel core grit with 0.175 percent of KYNAR® coating or steel with two polymer coatings of KYNAR®/PMMA.

Also, there is a need for toner compositions which have the desired triboelectric charge level, for example, from about 10 to about 40 microcoulombs per gram, and preferably from about 10 to about 25 microcoulombs per gram, and admix charging rates of from about 5 to about 60 seconds, and preferably from about 15 to about 30 seconds, as determined by the charge spectrograph, preferably, for example, at low concentrations, that is, for example, less than 1 percent, and preferably less than about 0.5 percent of the charge enhancing additive of the present invention and wherein the toners possess excellent humidity sensitivity at relative humidities of from about 20 to about 80 percent, and wherein during toner extrusion processing the use of separate charge additives can be avoided. Furthermore, there is a need for toner compositions which do not require charge enhancing additive during the extrusion process, which tends to generate toners with a nonhomogeneous incorporation of charge enhancing additives.

SUMMARY OF THE INVENTION

It is an object of the present invention to provide toner and developer compositions wherein the polymeric resin is comprised of a charge enhancing functionality.

In another object of the present invention there are provided positively charged toner compositions useful for the development of electrostatic latent images including color images, and wherein the charge control component is chemically linked or bonded to the polymeric base resin.

In yet another object of the present invention there are provided positively charged toner compositions containing polymers having chemically attached thereto a sulfo group with a counterion moiety comprised of a quaternary tetralkyl ammonium group, especially distearyl dimethylammonium, alkali and alkaline earth metal such as sodium, lithium, calcium and the like.

In yet another object of the present invention there are provided positively charged toner compositions containing polymers having chemically attached thereto tetraalkylammonium sulfonates, such as dimethyl distearyl ammonium sulfonate charge enhancing species.

Also, in another object of the present invention there are provided developer compositions with negatively charged toner particles, and carrier particles.

In yet a further object of the present invention there are provided humidity insensitive, from about, for example, 20 to 80 percent relative humidity at temperatures of from 60 to 80° F. as determined in a relative humidity testing chamber, positively charged toner compositions with desirable admix properties of 5 seconds to 60 seconds as determined by the charge spectrograph, and preferably less than 15 seconds, for example, and more preferably from about 1 to about 14 seconds, and acceptable triboelectric charging characteristics of from about 10 to about 40 microcoulombs per gram.

Additionally, in a further object of the present invention there are provided magnetic toner compositions, and positively charged colored toner compositions containing therein, or thereon the polymeric charge enhancing functionality illustrated herein.

Furthermore, in yet another object of the present invention there are provided toner and developer compositions that are useful in a variety of electrostatic imaging and printing processes, including color xerography, and wherein the admix charging times are less than or equal to about 60 seconds.

Another object of the present invention resides in the formation of toners which will enable the development of images in electrophotographic imaging apparatuses, which images have substantially no background deposits thereon, are substantially smudge proof or smudge resistant, and therefore are of excellent resolution; and further, such toner compositions can be selected for high speed electrophotographic apparatuses, that is those exceeding 70 copies per minute.

These and other objects of the present invention can be accomplished in embodiments thereof by providing toner compositions comprised of pigment particles, and a polymeric resin wherein the charge enhancing functionality is chemically attached to the resin. More specifically, the present invention in embodiments is directed to toner compositions comprised of resin, pigment, or dye, and a polymer having chemically attached thereto a known charge functional moiety such as a sulfo group with a counterion such as alkali or alkaline earth metals like sodium, calcium, zinc, barium, lithium, ammonium, distearyl dimethyl ammonium, tetra-alkyl ammonium, wherein the alkyl, for example, contains from 1 to about 30 carbon atoms, and the like. The aforementioned charge additives can be incorporated into the toner, may be present on the toner surface or may be present on toner surface additives such as colloidal silica particles. Advantages of rapid admix, appropriate triboelectric characteristics, avoidance of a separate charge additive, and the like are achieved with many of the aforementioned toners of the present invention.

In another embodiment of the present invention there is provided subsequent to known micronization and classification to enable toner particles with an average diameter of from about 10 to about 20 microns comprised of pigment particles, and the polymeric resin containing a charge enhancing functionality chemically attached as illustrated herein.

Examples of polymeric resins that may be selected for the chemical attachments, that is by covalent bonding, of a charge enhancing functional group, include a polyester, a styrene acrylate, a styrene methacrylate, a styrene butadiene, and the like. Examples of other polymeric resin that may be selected include polyimides, polyolefins, styrene acrylates, styrene methacrylate, styrene butadienes, crosslinked styrene polymers, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like; styrene butadiene copolymers with a styrene content of from about 70 to about 95 weight percent, reference the U.S. patents mentioned herein, the disclosures of which have been totally incorporated herein by reference. In addition, crosslinked resins, including polymers, copolymers, homopolymers of the aforementioned styrene polymers may be selected.

As one polymer there are selected the esterification products of a dicarboxylic acid and a diol comprising a diphenol. These polymers are illustrated in U.S. Pat. No. 3,590,000, the disclosure of which is totally incorporated herein by reference. Other specific polymer includes styrene/methacrylate copolymers, and styrene/butadiene copolymers; PLIOLITES®; suspension polymerized styrene butadienes, reference U.S. Pat. No. 4,558,108, the disclosure of which is totally incorporated herein by reference; polyesters obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof.

A polymeric resin containing charge enhancing functional group chemically attached, includes, for example, a polyester such as poly(1,2-propylene-sodio 5-sulfoisophthalate), poly(1,2-propylene-calcio 5-sulfoisophthalate), poly(1,2-propylene-tetralkylammonium 5-sulfoisophthalate), poly (ethylene-sodio 5-sulfoisophthalate), poly(ethylene-calcio 5-sulfoisophthalate), poly(ethylene-dimethyldistearylammonio 5-sulfoisophthalate), copoly(1,2-propylene-diethylene-terephthalate), copoly(1,2-propylene-diethylene sodio-5-sulfoisophthalate), copoly(1,2-propylene-diethylene-terephthalate), copoly(1,2-propylene-diethylene calcio-5-sulfoisophthalate), copoly(1,2-propylene-diethylene-terephthalate), copoly(1,2-propylene-diethylene calcio-5-sulfoisophthalate), copoly(1,2-propylene-diethylene-terephthalate), copoly(1,2-propylene-diethylene dimethyldistearylammonio-5-sulfoisophthalate), copoly(propoxylated bisphenol A-fumarate), or copoly(propoxylated bisphenol A-sodio 5-sulfoisophthalate).

The charge enhancing functional group that is chemically attached to the polymeric resin, especially resins obtained by condensation processes, such as polyesters, include the hydrogen, sodium, calcium, ammonium, tetralkylammonium salt of dimethyl 5-sulfo-1,3 isophthalate, dimethyl 5-sulfo-1,4 terephthalate, dimethyl 3-sulfo-1,2 phthalate, dimethyl sulfonaphthalene, sulfonaphthalene dianhydride, 2-sulfo propanediol, mixtures thereof, and the like. The charge enhancing functional group is selected in effective amounts of, for example, from about 0.05 percent to about 10 percent by weight of the resin, and preferably from about 0.5 percent to about 8 percent by weight of the resin.

In embodiments, the present invention is directed to a toner composition comprised of resin particles, pigment and a charge enhancing additive comprised of a polymer with a charge enhancing moiety chemically attached thereto, and which charge additive is of the formula

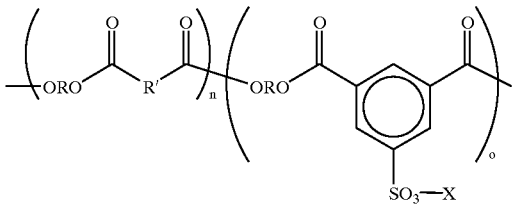

wherein X is an alkaline, an alkaline earth metal, a metal, or the ammonium cation $H_4N+$, or $R''_4N+$ wherein R" is an alkyl or arylalkyl group; R is alkylene, cyclohexyl, bisphenol, bis(alkyloxyl)bisphenol, or oxyalkylene; and R' is an alkylene, an arylene, or cycloalkylene group; and more specifically wherein the charge additive is a polyester with poly(1,2-propylene-sodio 5-sulfoisophthalate), poly(1,2-propylene-calcio 5-sulfoisophthalate), poly(1,2-propylene-tetralkylammonium 5-sulfoisophthalate), poly(ethylene-sodio 5-sulfoisophthalate), poly(ethylene-calcio 5-sulfoisophthalate), poly(ethylene-dimethyldistearylammonio 5-sulfoisophthalate), copoly(1,2-propylene-diethylene-terephthalate), copoly( 1,2-propylene-diethylene sodio-5-sulfoisophthalate), copoly(1,2-propylene-diethylene-terephthalate), copoly(1,2-propylene-diethylene calcio-5-sulfoisophthalate), copoly(1,2-propylene-diethylene-terephthalate), copoly(1,2-propylene-diethylene calcio-5-sulfoisophthalate), copoly(1,2-propylene-diethylene-terephthalate), copoly(1,2-propylene-diethylene dimethyldistearylammonio-5-sulfoisophthalate), copoly(propoxylated bisphenol A-fumarate), or copoly(propoxylated bisphenol A-sodio 5-sulfoisophthalate).

The toner compositions of the present invention can be prepared by a number of known methods such as admixing and heating the polymeric resin containing the charge enhancing group, pigment particles such as magnetite, carbon black, or mixtures thereof, and preferably from about 0.5 percent to about 5 percent of the aforementioned polymeric charge enhancing additives, or mixtures of charge additives in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns in average volume diameter, and preferably of from about 8 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter.

The polymeric resin containing the charge enhancing group selected for the toner and developer compositions of the present invention, such as the copoly(1,2-propylene diethylene terephthalate)-copoly-(1,2-propylene diethylene sodium 5-sulfoisophthalate) can be prepared by charging a 1 liter Parr reactor equipped with a mechanical stirrer and side condenser, a mixture of from about 0.9 to about 0.95 mole of dimethylterephthalate, from about 0.5 to about 1 mole of sodium 5-sulfo-1,3 dimethylisophthalate, from about 1.75 mole to about 1.85 moles of 1,2-propanediol, from about 0.15 to about 0.3 mole of diethylene glycol and from about 0.01 moles to about 0.05 mole of a condensation catalyst such as butyl tin oxide. The reactor is subsequently heated to 170° C. for a duration of from about 360 minutes to about 720 minutes with stirring at from about 10 revolution per minute to about 200 revolution per minute. During this time, from about 1.7 mole to about 2.0 mole of methanol byproduct can be collected through the condenser. The reactor temperature is then raised to about 200° C. and the pressure is reduced to about 1 millibar over a 2 hour to a 3 hour period. The polymeric resin, comprised of copoly(1,2-propylene diethylene terephthalate)-copoly-(1,2-propylene diethylene sodium 5-sulfoisophthalate), is then collected.

Also, waxes with a molecular weight of from about 1,000 to about 20,000, such as polyethylene, polypropylene, and paraffin waxes, can be included in, or on the toner compositions as fuser roll release agents. Also, the toner resins of U.S. Ser. No. 814,641 now U.S. Pat. No. 5,376,494 and U.S. Pat. No. 5,227,460, the disclosures of which are totally incorporated herein by reference, can be selected.

Numerous well known suitable pigments or dyes can be selected as the colorant for the toner particles including, for example, carbon black, like REGAL 330®, nigrosine dye, aniline blue, phthalocyanines, magnetite, or mixtures thereof. A number of carbon blacks available from, for example, Cabot Corporation can be selected. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition.

When the pigment particles are comprised of magnetites, thereby enabling single component magnetic toners in some instances, which magnetites are a mixture of iron oxides ($FeO.Fe_2O_3$) including those commercially available as MAPICO BLACK™, they are present in the toner composition in an amount of from about 10 percent by weight to about 80 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK™, in an amount of, for example, from about 5 to about 60, and preferably from about 10 to about 50 weight percent can be selected.

There can also be blended with the toner compositions of the present invention other toner additives, such as external additive particles, including flow aid additives, which additives are usually present on the surface thereof. Examples of these additives include metal oxides like titanium oxide, tin oxide, mixtures thereof, and the like; colloidal silicas such as AEROSIL®, metal salts and metal salts of fatty acids inclusive of zinc stearate, aluminum oxides, cerium oxides; and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

With further respect to the present invention, colloidal silicas, such as AEROSIL®, can be surface treated with the charge additives of the present invention illustrated herein in an amount of from about 1 to about 30 weight percent, and preferably 10 weight percent followed by the addition thereof to the toner in an amount of from 0.1 to 10 and preferably 0.1 to 1 weight percent.

Also, there can be included in the toner compositions of the present invention low molecular weight, for example from about 1,000 to about 20,00 weight average molecular weight, waxes, such as polypropylenes and polyethylenes commercially available from Allied Chemical and Petrolite Corporation, EPOLENE N-15™ commercially available from Eastman Chemical Products, Inc., VISCOL 550-P™, a low weight average molecular weight polypropylene available from Sanyo Kasei K. K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 5,000. Many of the polyethylene and polypropylene compositions useful in the present invention are illustrated in British Patent No. 1,442,835, the disclosure of which is totally incorporated herein by reference.

The low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

Encompassed within the scope of the present invention are colored toner and developer compositions comprised of toner resin particles illustrated herein, and optional carrier particles, and as pigments or colorants red, blue, green, brown, magenta, cyan and/or yellow particles, as well as mixtures thereof. More specifically, with regard to the generation of color images utilizing a developer composition with the charge enhancing additives of the present invention, illustrative examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles of the present invention are selected to be of a negative or positive polarity enabling the toner particles, which are oppositely charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methyl methacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances, such as carbon black, in an amount of from about 5 to about 30 percent by weight. Polymer coatings not in close proximity in the triboelectric series can also be selected, reference U.S. Pat. No. 4,937,166 and U.S. Pat. No. 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000 and preferably from about 75 to about 200 microns in diameter thereby permitting them to possess sufficient density and inertia to avoid adherence to the electrostatic images during the development process. The carrier component can be mixed with the toner composition in various suitable combinations, such as from about 1 to 5 parts per toner to about 100 parts to about 200 parts by weight of carrier are selected.

The toner and developer compositions of the present invention may be selected for use in electrostatographic imaging apparatuses containing therein conventional photoreceptors providing that they are capable of being charged negatively. Thus, the toner and developer compositions of the present invention can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys. Other similar photoreceptors can be selected providing the objectives of the present invention are achievable.

The toner compositions are usually jetted and classified subsequent to preparation to enable toner particles with a preferred average diameter of from about 5 to about 25 microns, and more preferably from about 8 to about 12 microns. Also, the toner compositions of the present invention preferably possess a triboelectric charge of from about 0.1 to about 2 femtocoulombs per micron in embodiments thereof as determined by the known charge spectograph. Admix time for the toners of the present invention are preferably from about 5 seconds to 1 minute, and more specifically from about 5 to about 15 seconds in embodiments thereof as determined by the known charge spectograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute.

With further respect to the present invention, one developer composition is comprised of a toner composition containing as a charge additive a polyester with distearyl methyl hydrogen bisulfate covalently bonded thereto, pigment particles such as carbon black, resin particles, and carrier particles comprised of a core containing thereover a plurality and preferably two polymeric coatings, namely a first polymeric coating of, for example, KYNAR®, 60 weight percent, and a second polymeric coating of, for example, polymethacrylate, 40 weight percent, at a total coating weight of 1.25 weight percent, which coatings are not in close proximity in the triboelectric series, reference U.S. Pat. No. 4,937,166 and U.S. Pat. No. 4,935,326, the disclosures of each of these applications being totally incorporated herein by reference. With the aforementioned carriers, in embodiments from about 0.1 to about 0.5 weight percent of the charge enhancing additive can be selected. Accordingly, for example, small amounts of charge enhancing additives can be selected for developers with carrier particles containing a double polymeric coating thereover.

The following Examples are being supplied to further define various species of the present invention, it being noted that these Examples are intended to illustrate and not limit the scope of the present invention. Parts and percentages are by weight unless otherwise indicated.

COMPARATIVE EXAMPLE I

A polyester resin, poly(1,2-propylene-diethylene-terephthalate), with no charge enhancing moiety chemically attached to the resin and with an average molecular weight of 10,500 grams per mole and having a diethylene/1,2-propylene ratio of 15:85, respectively, was prepared as follows.

A 7.6 liter Parr reactor equipped with a bottom drain valve, double turbine agitator and distillation receiver with a cold water condenser was charged with 3,250 grams of dimethylterephthalate, 2,369 grams of 1,2-propanediol (1 equivalent excess), 267.9 grams of diethylene glycol, 51 grams of stearic acid, and 4.7 gram of butyl tin oxide catalyst obtained as FASCAT 4100® from Elf Atochem North America Inc. The reactor was then heated to 165° C. with stirring at 150 revolutions per minute and then heated to 200° C. over a duration of 6 hours, wherein the methanol byproduct (845 grams) was collected via the distillation receiver to a container, and was comprised of about 98 percent by volume of methanol and 2 percent by volume of 1,2-propanediol as measured by the ABBE refractometer available from American Optical Corporation. The mixture was then maintained at 200° C., and the pressure was reduced from atmospheric to about 0.2 millibar over a duration of about 3 hours. During this time, there were further collected approximately 890 grams of distillate in the distillation receiver, comprised of approximately 1,172 grams of glycol, with about 97 percent by volume of 1,2-propanediol and 3 percent by volume of methanol as measured by the ABBE refractometer. The reactor was then purged with nitrogen to atmospheric pressure, and the polymer discharged through the bottom drain onto a container cooled with dry ice to yield 3.65 kilograms of poly(1,2-propylene-diethylene -terephthalate)-stearate resin. The aforementioned resin product glass transition temperature was measured to be 57° C. (onset) utilizing the 910 Differential Scanning Calorimeter available from E.I. DuPont operating at a heating rate of 10° C. per minute. The number average molecular weight of the polyester product resin was measured to be 6,000 grams per mole and the weight average molecular weight was measured to be 10,500 grams per mole using tetrahydrofuran as the solvent and obtained with the 700 Satelite WISP gel permeation chromatograph available from Waters Company equipped with a styrogel column.

EXAMPLE II

A polyester resin with 1.0 weight percent of sodium 5-sulfoisophthalate charge enhancing moiety chemically attached to the resin derived from dimethyl terephthalate and a diethylene/1,2-propylene ratio of 15:85, respectively, was prepared as follows.

A 1 liter Parr reactor equipped with a bottom drain valve, double turbine agitator and distillation receiver with a cold water condenser was charged with 374 grams of dimethylterephthalate, 4.1 grams of the sodium salt of dimethyl 5-sulfoisophthalate, 276 grams of 1,2-propanediol (1 equivalent excess), 31 grams of diethylene glycol, 5.5 grams of stearic acid, and 0.8 gram of butyl tin oxide catalyst obtained as FASCAT 4100® from Elf Atochem North America Inc. The reactor was then heated to 165° C. with stirring at 150 revolutions per minute and then heated to 200° C. over a duration of 6 hours, wherein the methanol byproduct was collected via the distillation receiver to a container, and was comprised of about 98 percent by volume of methanol and 2 percent by volume of 1,2-propanediol as measured by the ABBE refractometer available from American Optical Corporation. The mixture was then maintained at 200° C., and the pressure was reduced from atmospheric to about 0.2 millibar over a duration of about 3 hours. During this time, the 1 mole excess of 1,2-propanediol was collected by distillation. The reactor was then purged with nitrogen to atmospheric pressure, and the polymer discharged through the bottom drain onto a container cooled with dry ice to yield 3.65 kilograms of copoly(1,2-propylene-diethylene-terephthalate)-stearate-copoly(1,2-propylene-diethylene-5-sulfoisophthalate sodium salt)-stearate resin. The aforementioned resin product glass transition temperature was measured to be 55.5° C. (onset) utilizing the 910 Differential Scanning Calorimeter available from E. I. DuPont operating at a heating rate of 10° C. per minute. The number average molecular weight of the polyester product resin was measured to be 5,100 grams per mole and the weight average molecular weight was measured to be 9,300 grams per mole using tetrahydrofuran as the solvent and obtained with the 700 Satelite WISP gel permeation chromatograph available from Waters Company equipped with a styrogel column.

EXAMPLE III

A polyester resin with 1 weight percent of calcium 5-sulfoisophthalate charge enhancing moiety chemically attached to the resin derived from dimethyl terephthalate and a diethylene/1,2-propylene ratio of 15:85, respectively, was prepared as follows.

A 500 milliliter flask equipped with a mechanical stirrer was charged with 150 grams of the copoly(1,2-propylene-diethylene -terephthalate)-stearate-copoly(1,2-propylene-diethylene-5-sulfoisophthalate sodium salt)-stearate resin of Example II, and 300 grams of acetone. After 2 hours of stirring, the polymer was completely dissolved and 300 milligrams of calcium chloride dissolved in 2 grams of water were added. After stirring for an additional 30 minutes, the polymer was precipitated with water, filtered off and dried to yield approximately 140 grams of copoly(1,2-propylene-diethylene-terephthalate)-stearate-copoly(1,2-propylene-diethylene-5-sulfoisophthalate calcium salt)-stearate resin. The aforementioned resin product glass transition temperature was measured to be 54.5° C. (onset) utilizing the 910 Differential Scanning Calorimeter available from E.I. DuPont operating at a heating rate of 10° C. per minute.

EXAMPLE IV

A polyester resin with 1 weight percent of dimethyl distearyl ammonium salt of 5-sulfoisophthalate charge enhancing moiety chemically attached to the resin derived from dimethyl terephthalate and a diethylene/1,2-propylene ratio of 15:85, respectively, was prepared as follows.

A 500 milliliter flask equipped with a mechanical stirrer was charged with 150 grams of the copoly(1,2-propylene-diethylene -terephthalate)-stearate-copoly(1,2-propylene-diethylene-5-sulfoisophthalate sodium salt)-stearate resin of Example II, and 300 grams of acetone. After 2 hours of stirring, the polymer was completely dissolved and 1.8 grams of dimethyl distearyl ammonium bromide with 5 grams of water were added. After stirring for an additional 30 minutes, the polymer was precipitated with water, filtered off and dried to yield approximately 145 grams of copoly (1,2-propylene-diethylene-terephthalate)-stearate-copoly(1, 2-propylene-diethylene-5-sulfoisophthalate dimethyl distearyl ammonium salt)-stearate resin. The aforementioned resin product glass transition temperature was measured to be 54° C. (onset) utilizing the 910 Differential Scanning Calorimeter available from E.I. DuPont operating at a heating rate of 10° C. per minute.

EXAMPLE V

A polyester resin with 4 weight percent of sodium 5-sulfoisophthalate charge enhancing moiety chemically attached to the resin derived from dimethyl terephthalate and a diethylene/1,2-propylene ratio of 15:85, respectively, was prepared as follows.

A 1 liter Parr reactor equipped with a bottom drain valve, double turbine agitator and distillation receiver with a cold water condenser was charged with 374 grams of dimethylterephthalate, 43.4 grams of the sodium salt of dimethyl 5-sulfoisophthalate, 276 grams of 1,2-propanediol (1 equivalent excess), 31 grams of diethylene glycol, 5.1 grams of stearic acid, and 0.8 gram of butyl tin oxide catalyst obtained as FASCAT 4100® from Elf Atochem North America Inc. The reactor was then heated to 165° C. with stirring at 150 revolutions per minute and then heated to 200° C. over a duration of 6 hours, wherein the methanol byproduct was collected via the distillation receiver to a container, and was comprised of about 98 percent by volume of methanol and 2 percent by volume of 1,2-propanediol as measured by the ABBE refractometer available from American Optical Corporation. The mixture was then maintained at 200° C., and the pressure was reduced from atmospheric to about 0.2 millibar over a duration of about 3 hours. During this time, the 1 mole excess of 1,2-propanediol was collected by distillation. The reactor was then purged with nitrogen to atmospheric pressure, and the polymer discharged through the bottom drain onto a container cooled with dry ice to yield 3.65 kilograms of copoly(1,2-propylene-diethylene-terephthalate)-stearate-copoly(1,2-propylene-diethylene-5-sulfoisophthalate sodium salt)-stearate resin. The aforementioned resin product glass transition temperature was measured to be 57° C. (onset) utilizing the 910 Differential Scanning Calorimeter available from E.I. DuPont operating at a heating rate of 10° C. per minute. The number average molecular weight of the polyester product resin was measured to be 5,800 grams per mole and the weight average molecular weight was measured to be 9,800 grams per mole using tetrahydrofuran as the solvent and obtained with the 700 Satelite WISP gel permeation chromatograph available from Waters Company equipped with a styrogel column.

EXAMPLE VI

A polyester resin with 4 weight percent of calcium 5-sulfoisophthalate charge enhancing moiety chemically attached to the resin and with an average molecular weight of grams per mole and having a diethylene/1,2-propylene ratio of 15:85, respectively, was prepared as follows.

A 500 milliliter flask equipped with a mechanical stirrer was charged with 150 grams of the copoly(1,2-propylene-diethylene -terephthalate)-stearate-copoly(1,2-propylene-diethylene-5-sulfoisophthalate sodium salt)-stearate resin of Example II, and 300 grams of acetone. After 2 hours of stirring, the polymer was completely dissolved and 1.2 grams of calcium chloride dissolved in 5 grams of water were added. After stirring for an additional 30 minutes, the polymer was precipitated with water, filtered off and dried to yield approximately 140 grams of copoly(1,2-propylene-diethylene-terephthalate)-stearate-copoly(1,2-propylene-diethylene-5-sulfoisophthalate calcium salt)-stearate resin. The aforementioned resin product glass transition temperature was measured to be 56.5° C. (onset) utilizing the 910 Differential Scanning Calorimeter available from E.I. DuPont operating at a heating rate of 10° C. per minute.

EXAMPLE VII

A polyester resin with 1 weight percent of dimethyl distearyl ammonium salt of 5-sulfoisophthalate charge enhancing moiety chemically attached to the resin derived from dimethyl terephthalate and a diethylene/1,2-propylene ratio of 15:85, respectively, was prepared as follows.

A 7.6 liter Parr reactor equipped with a bottom drain valve, double turbine agitator and distillation receiver with a cold water condenser was charged with 1,870 grams of dimethylterephthalate, 20.5 grams of the sodium salt of dimethyl 5-sulfoisophthalate, 1,380 grams of 1,2-propanediol (1 equivalent excess), 155 grams of diethylene glycol, 43.7 grams of dimethyl distearyl ammonium bromide, and 4.08 grams of butyl tin oxide catalyst obtained as FASCAT 4100® from Elf Atochem North America Inc. The reactor was then heated to 165° C. with stirring at 150 revolutions per minute and then heated to 200° C. over a duration of 6 hours, wherein the methanol byproduct (845 grams) was collected via the distillation receiver to a container, and was comprised of about 98 percent by volume of methanol and 2 percent by volume of 1,2-propanediol as measured by the ABBE refractometer available from American Optical Corporation. The mixture was then maintained at 200° C., and the pressure was reduced from atmospheric to about 0.2 millibar over a duration of about 3 hours. During this time, there was further collected approximately 895 grams of distillate in the distillation receiver, comprised of approximately 1,150 grams of glycol, with about 97 percent by volume of 1,2-propanediol and 3 percent by volume of methanol as measured by the ABBE refractometer. The reactor was then purged with nitrogen to atmospheric pressure, and the polymer discharged through the bottom drain onto a container cooled with dry ice to yield 2.2 kilograms of copoly(1,2-propylene-diethylene-terephthalate)-stearate-copoly(1,2-propylene-diethylene-5-sulfoisophthalate dimethyl distearyl ammonium salt)-stearate resin. The aforementioned resin product glass transition temperature was measured to be 60.5° C. (onset) utilizing the 910 Differential Scanning Calorimeter available from E.I. DuPont operating at a heating rate of 10° C. per minute. The number average molecular weight of the polyester product resin was measured to be 6,100 grams per mole and the weight average molecular weight was measured to be 10,600 grams per mole using tetrahydrofuran as the solvent and obtained with the 700 Satelite WISP gel permeation chromatograph available from Waters Company equipped with a styrogel column.

COMPARATIVE EXAMPLE VIII

A toner composition comprised of 98 percent by weight of the polyester resin or moiety of Comparative Example I, which contains no charge enhancing agent, and 2 percent by weight of PV FAST BLUE™ pigment was prepared as follows.

The polyester resin of Comparative Example I was in the form of a large chunk. The resulting polymer was ground to about 500 microns average volume diameter in a Model J Fitzmill equipped with an 850 micrometer screen. After grinding, 59 grams of polymer were mixed with 1 gram of PV FAST BLUE™ pigment. The two components were mixed utilizing a Black and Decker Coffee Grinder. The mixed components were then extruded utilizing the CS-194A twin screw extruder available from Custom Scientific Instruments at a barrel temperature of 140° C. An 8 inch Sturtevant micronizer was used to reduce the particle size further. After grinding, the toner was measured to display an average volume diameter particle size of 7.4 microns with a geometric distribution of 1.45 as measured by the Coulter Counter. The resulting toner was then utilized without further classification. A developer composition with negatively charged toner was prepared by roll milling the aforementioned toner, 3 parts by weight, with 100 parts by weight of a 90 micron diameter carrier comprised of a ferrite core with 0.55 percent by weight of polymer comprised of methyl methacrylate (80.4 percent), vinyltriethoxysilane (5 percent) and styrene (14.1 percent) as coating thereof. A developer composition with positively charged toner was also prepared by roll milling the aforementioned toner, 3 parts by weight, with 100 parts by weight of a 120 micron diameter carrier comprised of a steel core with 0.15 percent by weight of polyvinylidene fluoride coating. The toner triboelectric charge -to-mass ratio, Q/M, was measured using the standard known blow-off Faraday Cage apparatus after the toner and carrier had been equilibrated in various relative humidity zones of 20 percent and 80 percent relative humidity. The relative humidity was then obtained by the ratio of the corresponding triboelectric charge at 20 percent RH to 80 percent RH. The triboelectric charge data and relative humidity sensitivity for the toner of this Example are provided in Tables 1 and 2.

EXAMPLE IX

A toner composition comprised of 98 percent by weight of the polyester resin of Example II, which contains a sodium 5-sulfoisophthalate charge enhancing component, and 2 percent by weight of PV FAST BLUE™ pigment was prepared as follows.

The polyester resin of Example II was in the form of a large chunk. The resulting polymer was ground to about 500 microns average volume diameter in a Model J Fitzmill equipped with an 850 micrometer screen. After grinding, 59 grams of polymer were mixed with 1 gram of PV FAST BLUE™ pigment. The two components were mixed utilizing a Black and Decker Coffee Grinder. The mixed components were then extruded utilizing the CS-194A twin screw extruder available from Custom Scientific Instruments at a barrel temperature of 140° C. An 8 inch Sturtevant micronizer was used to reduce the particle size further. After grinding, the toner was measured to display an average volume diameter particle size of 7.2 microns with a geometric distribution of 1.43 as measured by the Coulter Counter. The resulting toner was then utilized without further classification. A negatively charged toner and developer composition was prepared by roll milling the aforementioned toner, 3 parts by weight, with 100 parts by weight of a 90 micron diameter carrier comprised of a ferrite core with 0.55 percent by weight of polymer comprised of methyl methacrylate (80.4 percent), vinyltriethoxysilane (5 percent) and styrene (14.1 percent) as coating thereof. A positively charged toner and developer composition was also prepared by roll milling the aforementioned toner, 3 parts by weight, with 100 parts by weight of a 120 micron diameter carrier comprised of a steel core with 0.15 percent by weight of polyvinylidene fluoride coating. The toner triboelectric charge-to-mass ratio, Q/M, was measured using the standard known blow-off Faraday Cage apparatus, after the toner and carrier had been equilibrated in various relative humidity zones of 20 percent and 80 percent relative humidity. The relative humidity was then obtained by the ratio of the corresponding triboelectric charge at 20 percent RH to 80 percent RH. The triboelectric charge data and relative humidity sensitivity for the toner of this Example are provided in Tables 1 and 2.

EXAMPLE X

A toner composition comprised of 98 percent by weight of the polyester resin of Example III, which contains a calcium 5-sulfoisophthalate charge enhancing agent moiety, and 2 percent by weight of PV FAST™ pigment was prepared as follows.

The polyester resin of Example III was in the form of a large chunk. The resulting polymer was ground to about 500 microns average volume diameter in a Model J Fitzmill equipped with an 850 micrometer screen. After grinding, 59 grams of polymer were mixed with 1 gram of PV FAST BLUE™ pigment. The two components were mixed utilizing a Black and Decker Coffee Grinder. The mixed components were then extruded utilizing the CS-194A twin screw extruder available from Custom Scientific Instruments at a barrel temperature of 140° C. An 8 inch Sturtevant micronizer was used to reduce the particle size further. After grinding, the toner was measured to display an average volume diameter particle size of 7.0 microns with a geometric distribution of 1.41 as measured by the Coulter Counter. The resulting toner was then utilized without further classification. A negatively charged toner and developer composition was prepared by roll milling the aforementioned toner, 3 parts by weight, with 100 parts by weight of a 90 micron diameter carrier comprised of a ferrite core with 0.55 percent by weight of polymer comprised of methyl methacrylate (80.4 percent), vinyltriethoxysilane (5 percent) and styrene (14.1 percent) as coating thereof. A positively charged toner and developer composition was also prepared by roll milling the aforementioned toner, 3 parts by weight, with 100 parts by weight of a 120 micron diameter carrier comprised of a steel core with 0.15 percent by weight of polyvinylidene fluoride coating. The toner triboelectric charge-to-mass ratio, Q/M, was measured using the standard known blow-off Faraday Cage apparatus, after the toner and carrier had been equilibrated in various relative humidity zones of 20 percent and 80 percent relative humidity. The relative humidity was then obtained by the ratio of the corresponding triboelectric charge at 20 percent RH to 80 percent RH. The triboelectric charge data and relative humidity sensitivity for the toner of this Example are provided in Tables 1 and 2.

EXAMPLE XI

A toner composition comprised of 98 percent by weight of the polyester resin of Example IV, which contains a dimethyl distearyl ammonium 5-sulfoisophthalate charge enhancing component, and 2 percent by weight of PV FAST BLUE™ pigment was prepared as follows.

The polyester resin of Example IV was in the form of a large chunk. The resulting polymer was ground to about 500 microns average volume diameter in a Model J Fitzmill equipped with an 850 micrometer screen. After grinding, 59 grams of polymer were mixed with 1 gram of PV FAST BLUE™ pigment. The two components were mixed utilizing a Black and Decker Coffee Grinder. The mixed components were then extruded utilizing the CS-194A twin screw extruder available from Custom Scientific Instruments at a barrel temperature of 140° C. An 8 inch Sturtevant micronizer was used to reduce the particle size further. After grinding, the toner was measured to display an average volume diameter particle size of 7.1 microns with a geometric distribution of 1.41 as measured by the Coulter Counter. The resulting toner was then utilized without further classification. A negatively charged toner and developer composition was prepared by roll milling the aforementioned toner, 3 parts by weight, with 100 parts by weight of a 90 micron diameter carrier comprised of a ferrite core with 0.55 percent by weight of polymer comprised of methyl methacrylate (80.4 percent), vinyltriethoxysilane (5 percent) and styrene (14.1 percent) as coating thereof. A positively charged toner and developer composition was prepared by roll milling the aforementioned toner, 3 parts by weight, with 100 parts by weight of a 120 micron diameter carrier comprised of a steel core with 0.15 percent by weight of polyvinylidene fluoride coating. The toner triboelectric charge-to-mass ratio, Q/M, was measured using the standard known blow-off Faraday Cage apparatus after the toner and carrier had been equilibrated in various relative humidity zones of 20 percent and 80 percent relative humidity. The relative humidity was then obtained by the ratio of the corresponding triboelectric charge at 20 percent RH to 80 percent RH. The triboelectric charge data and relative humidity sensitivity for the toner of this Example are provided in Tables 1 and 2.

EXAMPLE XII

A toner composition comprised of 98 percent by weight of the polyester resin of Example V, which contains a sodium 5-sulfoisophthalate charge enhancing agent, and 2 percent by weight of PV FAST BLUE™ pigment was prepared as follows.

The polyester resin of Example V was in the form of a large chunk. The resulting polymer was ground to about 500 microns average volume diameter in a Model J Fitzmill equipped with an 850 micrometer screen. After grinding, 59 grams of polymer were mixed with 1 gram of PV FAST BLUE™ pigment. The two components were mixed utilizing a Black and Decker Coffee Grinder. The mixed components were then extruded utilizing the CS-194A twin screw extruder available from Custom Scientific Instruments at a barrel temperature of 140° C. An 8 inch Sturtevant micronizer was used to reduce the particle size further. After grinding, the toner was measured to display an average volume diameter particle size of 7.8 microns with a geometric distribution of 1.48 as measured by the Coulter Counter. The resulting toner was then utilized without further classification. A negatively charged toner and developer composition was prepared by roll milling the aforementioned toner, 3 parts by weight, with 100 parts by weight of a 90 micron diameter carrier comprised of a ferrite core with 0.55 percent by weight of polymer comprised of methyl methacrylate (80.4 percent), vinyltriethoxysilane (5 percent) and styrene (14.1 percent) as coating thereof. A positively charged toner and developer composition was also prepared by roll milling the aforementioned toner, 3 parts by weight, with 100 parts by weight of a 120 micron diameter carrier comprised of a steel core with 0.15 percent by weight of polyvinylidene fluoride coating. The toner triboelectric charge-to-mass ratio, Q/M, was measured using the standard known blow-off Faraday Cage apparatus after the toner and carrier had been equilibrated in various relative humidity zones of 20 percent and 80 percent relative humidity. The relative humidity was then obtained by the ratio of the corresponding triboelectric charge at 20 percent RH to 80 percent RH. The triboelectric charge data and relative humidity sensitivity for the toner of this Example are provided in Tables 1 and 2.

EXAMPLE XIII

A toner composition comprised of 98 percent by weight of the polyester resin of Example VI, which contains a calcium 5-sulfoisophthalate charge enhancing agent, and 2 percent by weight of PV FAST BLUE™ pigment was prepared as follows.

The polyester resin of Example VI was in the form of a large chunk. The resulting polymer was ground to about 500 microns average volume diameter in a Model J Fitzmill equipped with an 850 micrometer screen. After grinding, 59 grams of polymer were mixed with 1 gram of PV FAST BLUE™ pigment. The two components were mixed utilizing a Black and Decker Coffee Grinder. The mixed components were then extruded utilizing the CS-194A twin screw extruder available from Custom Scientific Instruments at a barrel temperature of 140° C. An 8 inch Sturtevant micronizer was used to reduce the particle size further. After grinding, the toner was measured to display an average volume diameter particle size of 7.5 microns with a geometric distribution of 1.42 as measured by the Coulter Counter. The resulting toner was then utilized without further classification. A developer composition was prepared by roll milling the aforementioned toner, 3 parts by weight, with 100 parts by weight of a 90 micron diameter carrier comprised of a ferrite core with 0.55 percent by weight of polymer comprised of methyl methacrylate (80.4 percent), vinyltriethoxysilane (5 percent) and styrene (14.1 percent) as coating thereof, and wherein the toner had a negative tribo charge. A developer composition was also prepared by roll milling the aforementioned toner, 3 parts by weight, with 100 parts by weight of a 120 micron diameter carrier comprised of a steel core with 0.15 percent by weight of polyvinylidene fluoride coating, and wherein the toner had a positive tribo charge. The toner triboelectric charge-to-mass ratio, Q/M, was measured using the standard known blow-off Faraday Cage apparatus after the toner and carrier had been equilibrated in various relative humidity zones of 20 percent and 80 percent relative humidity. The relative humidity was then obtained by the ratio of the corresponding triboelectric charge at 20 percent RH to 80 percent RH. The triboelectric charge data and relative humidity sensitivity for the toner of this Example are provided in Tables 1 and 2.

TABLE 1

TONER EVALUATION FOR NEGATIVE CHARGING

| TONER | Weight % Sulfonate Monomer | Counterion | Tribo Charge Q/M in Microcoulombs Per Gram 20% Relative Humidity | 80% Relative Humidity | Relative Humidity Sensitivity 20% RH 80% RH |
|---|---|---|---|---|---|
| Comparative Example VIII | 0 | none | −7.5 | −0.2 | 40.0 |
| Example IX | 1 | $Na^+$ | −49.0 | −7.5 | 6.5 |
| Example X | 1 | $Ca^{+2}$ | −23.0 | −7.0 | 3.2 |
| Example XI | 1 | $[CH_3(CH_2)_{15}]_2(CH_3)_2N^+$ | −84.0 | −20.0 | 4.2 |
| Example XII | 4 | $Na^+$ | −85.0 | −16.0 | 5.3 |
| Example XIII | 4 | $Ca^{+2}$ | −46.0 | −12.0 | 3.8 |

The toner without the inventive sulfonate monomer from Comparative Example VIII has unacceptable low negative charge of less than 10 microcoulombs per gram. Incorporation of the inventive sulfonate monomer with any of the cation counterions from Examples IX to XIII provides more negative charging properties at both 20 percent and 80 percent relative humidity, also providing acceptable negative charging of from about 7 to about 80 microcoulombs per gram, more negative than the toner without the inventive attached sulfonate monomer. The toner charge with the sulfonate monomer can be controlled to the desired level by changing either the nature of the counterion, or by changing the weight percentage of the attached sulfonate monomer in the toner, providing the observed range of negative charge of about 80 microcoulombs per gram. Also, the toner without the inventive sulfonate monomer from Comparative Example VIII has unacceptable high relative humidity sensitivity of 40. Incorporation of the inventive sulfonate monomer with any of the counterions from Examples IX to XIII provides a reduced relative humidity sensitivity of less than 7, and less than about 4 in some of the toner Examples.

TABLE 2

TONER EVALUATION FOR POSITIVE CHARGING

| TONER | Weight % Sulfonate Monomer | Counterion | Tribo Charge Q/M in Microcoulombs Per Gram 20% Relative Humidity | 80% Relative Humidity | Relative Humidity Sensitivity 20% RH 80% RH |
|---|---|---|---|---|---|
| Comparative Example VIII | 0 | none | 80 | 36 | 2.2 |
| Example IX | 1 | $Na^+$ | 61 | 27 | 2.3 |
| Example X | 1 | $Ca^{+2}$ | 76 | 32 | 2.4 |
| Example XI | 1 | $[CH_3(CH_2)_{15}]_2(CH_3)_2N^+$ | 40 | 32 | 1.26 |
| Example XII | 4 | $Na^+$ | 65 | 16 | 4.1 |
| Example XIII | 4 | $Ca^{+2}$ | 76 | 22 | 3.5 |

The toner without the inventive sulfonate monomer from Comparative Example VIII has a very high positive charge of 80 microcoulombs per gram at 20 percent relative humidity. Incorporation of the inventive sulfonate monomer with any of the counterions from Examples IX to XIII provides less positive charging properties at both 20 percent and 80 percent relative humidity, allowing acceptable positive charging of from about 4 to about 40 microcoulombs per gram less positive than the toner without the inventive sulfonate monomer. The toner charge with the sulfonate monomer can be controlled to the desired level by changing either the nature of the counterion, or by changing the amount of the attached sulfonate monomer in the toner, giving the observed range of positive charging of about 40 microcoulombs per gram. The toner without the inventive sulfonate monomer from Comparative Example VIII has a low relative humidity sensitivity of less than 2.5. Incorporation of 1 weight percent of the inventive sulfonate monomer with any of the cation counterions from Examples IX and XI provides essentially equivalent relative humidity sensitivity of less than 2.5, within the most preferred range in all toner Examples. Incorporation of 4 weight percent of the inventive sulfonate monomer with any of the cation counterions from Examples XI and XIII provides higher relative humidity sensitivity, but with relative humidity sensitivities of less than about 4 in all toner Examples. In Example X, with incorporation of 1 weight percent of the sulfonate monomer with the dimethyl distearyl ammonium cation, the relative humidity sensitivity is similar to the ideal value of 1.

Other embodiments and modifications of the present invention may occur to those skilled in the art subsequent to a review of the information presented herein; these embodiments and modifications, as well as equivalents thereof, are also included within the scope of this invention.

What is claimed is:

1. A toner composition consisting essentially of resin particles, pigment and a charge enhancing additive comprised of a polyester polymer with a charge enhancing moiety chemically attached thereto, and which charge enhancing additive is selected from the group consisting of poly(1,2-propylene-sodio 5-sulfoisophthalate), poly(1,2-propylene-calcio 5-sulfoisophthalate), poly(1,2-propylene-tetralkylammonium 5-sulfoisophthalate), poly(ethylene-sodio 5-sulfoisophthalate), poly(ethylene-calcio 5-sulfoisophthalate), poly(ethylene-dimethyldistearylammonio 5-sulfoisophthalate), copoly(1,2-propylene-diethylene sodio-5-sulfoisophthalate), copoly (1,2-propylene-diethylene calcio-5-sulfoisophthalate), (and copoly(1,2-propylene-diethylene dimethyldistearylammonio-5-sulfoisophthalate).

2. A toner composition in accordance with claim 1 wherein the charge enhancing additive comprised of a polymer with a charge enhancing moiety chemically attached is present in an amount of from about 90 to about 9 percent by weight.

3. A toner composition in accordance with claim 1 wherein the charge enhancing moiety chemically attached to the charge additive is present in an amount of from about 0.05 to about 10 percent by weight of toner.

4. A toner composition in accordance with claim 1 with a triboelectric charge of from about 7 to about 40 microcoulombs per gram.

5. A toner composition in accordance with claim 1 wherein the pigment is carbon black, magnetites, or mixtures thereof, cyan, magenta, yellow, red, blue, green, brown, and mixtures thereof.

6. A developer composition consisting of a toner composition comprised of resin particles, pigment and a charge enhancing additive selected from the group consisting of poly(1,2-propylene-sodio 5-sulfoisophthalate), poly(1,2-propylene-calcio 5-sulfoisophthalate), poly(1,2-propylene-tetralkylammonium 5-sulfoisophthalate), poly(ethylene-sodio 5-sulfoisophthalate), poly(ethylene-calcio 5-sulfoisophthalate), poly(ethylene-dimethyldistearylammonio 5-sulfoisophthalate), copoly(1,2-propylene-diethylene sodio-5-sulfoisophthalate), copoly (1,2-propylene-diethylene calcio-5-sulfoisophthalate), and copoly(1,2-propylene-diethylene dimethyldistearylammonio-5-sulfoisophthalate); and carrier particles.

7. A developer composition in accordance with claim 6 wherein the carrier particles are comprised of ferrites, steel, or an iron powder.

8. A developer composition in accordance with claim 7 wherein the carrier particles are comprised of a core with a polymer coating thereover.

9. A developer composition in accordance with claim 8 wherein the coating is comprised of a terpolymer of styrene, methacrylate and a vinyltriethoxysilane, a fluoropolymer, or a mixture of polymers not in close proximity in the triboelectric series.

10. A method of imaging consisting essentially of formulating an electrostatic latent image on a photoreceptor, affecting development thereof with a toner composition comprised of resin particles, pigment and a charge enhancing additive comprised of a polymer or resin particles with a charge enhancing moiety chemically attached thereto, and which charge additive is selected from the group consisting of poly(1,2-propylene-sodio 5-sulfoisophthalate), poly(1,2-propylene-calcio 5-sulfoisophthalate), poly(1,2-propylene-tetralkylammonium 5-sulfoisophthalate), poly(ethylene-sodio 5-sulfoisophthalate), poly(ethylene-calcio 5-sulfoisophthalate), poly(ethylene-dimethyldistearylammonio 5-sulfoisophthalate), copoly(1,2-propylene -diethylene sodio-5-sulfoisophthalate), copoly (1,2-propylene-diethylene calcio-5-sulfoisophthalate), and copoly(1,2-propylene-diethylene dimethyldistearylammonio-5-sulfoisophthalate); and thereafter transferring the developed image to a suitable substrate.

11. A toner composition consisting of resin particles, pigment, and a charge enhancing additive selected from the group consisting of copoly(1,2-propylene-diethylene-terephthalate)-stearate-copoly(1,2-propylene-diethylene-5-sulfoisophthalate sodium salt)-stearate resin, copoly(1,2-propylene -diethylene-terephthalate)-stearate-copoly(1,2-propylene-diethylene-5-sulfoisophthalate calcium salt)-stearate resin, and copoly(1,2-propylene-diethylene-terephthalate)-stearate-copoly(1,2-propylene-diethylene-5-sulfoisophthalate dimethyl distearyl ammonium salt)-stearate resin.

12. A developer comprised of a toner composition consisting essentially of resin particles, pigment, and the charge enhancing additive copoly(1,2-propylene-diethylene-terephthalate)-stearate-copoly(1,2-propylene-diethylene-5-sulfoisophthalate sodium salt)-stearate resin, copoly(1,2-propylene-diethylene-terephthalate)-stearate-copoly(1,2-propylene-diethylene-5-sulfoisophthalate calcium salt)-stearate resin, or copoly(1,2-propylene-diethylene-terephthalate)-stearate-copoly(1,2-propylene-diethylene-5-sulfoisophthalate dimethyl distearyl ammonium salt)-stearate resin; and carrier particles.

* * * * *